US005692456A

United States Patent [19]

Louks-Phillips

[11] Patent Number: 5,692,456

[45] Date of Patent: Dec. 2, 1997

[54] COMBINED HARNESS/VEST APPARATUS USED FOR RESTRAINT

[76] Inventor: Terry Marie Louks-Phillips, 1804 SE. 168th Ave., Vanc., Wash. 98683

[21] Appl. No.: 710,319

[22] Filed: Sep. 16, 1996

[51] Int. Cl.[6] ..... A62B 35/00

[52] U.S. Cl. ..... 119/770; 119/857

[58] Field of Search ..... 119/857, 770, 119/863

[56] References Cited

U.S. PATENT DOCUMENTS

| | | | |
|---|---|---|---|
| D. 343,257 | 1/1994 | DiFloria | D29/11 |
| 1,310,958 | 7/1919 | O'Connor . | |
| 1,574,672 | 2/1926 | McCarroll-Doull . | |
| 3,088,438 | 5/1963 | Oliphant . | |
| 4,667,624 | 5/1987 | Smith | 119/857 |
| 4,981,110 | 1/1991 | Llewellyn | 119/770 |
| 5,183,007 | 2/1993 | Vincent | 119/857 |
| 5,388,551 | 2/1995 | Martusciello | 119/770 |

*Primary Examiner*—Edgar S. Burr
*Assistant Examiner*—Amanda B. Sandusky

[57] ABSTRACT

A harness that is meant for and infant/child to wear, and a vest that is meant for an adult to wear, in which the two are joined together by the safety clips located at the waist and shoulder of the infant/child and the adult. This apparatus allows the adult a comfortable manner in which to restrain an infant/child to the upper body of the adult. The significance of this harness/vest apparatus is that an infant/child may be attached to a adult so that when traveling by airplane, and in the event that there is a emergency situation, the infant/child will not be pulled away from the adult and become severely injured or killed.

1 Claim, 2 Drawing Sheets

COMBINED HARNESS/VEST APPARATUS USED FOR RESTRAINT

BACKGROUND

1. Field of Invention

This invention relates to child safety harness, specifically used for restraining the infant/child to the body of the adult.

2. Description of Prior Art

Harness for children and infants have been in common use for various purposes, but the prior art has been directed primarily along the lines of use for restraining an infant/child to a particular location or position.

Patent examples are as follows:

a) U.S. Pat. No. 1,310,958 to R. C. O'Connor (1919), to prevent an infant from falling from a crib, chair, or carriage.

b) U.S. Pat. No. 1,574,672 to Clara McCarroll-Doull (1924), to prevent a baby or young child from falling out of a bed, cradle, bassinet, or buggy.

c) U.S. Pat. No. 3,088,438 to Virginia W. Oliphant (1963), to restrain a child within a given area.

d) U.S. Pat. No. Des. 343,257 to Mary-Jo C. DiFloria and Virginia G. Skapik (1994), to prevent a child from falling out of a shopping cart.

Although there has been prior art in the past relating to this harness/vest apparatus, none of the previous inventions provide a way in which to restrain the infant/child to the adult. The ability to restrain a infant/child to the adult is very important because the adult does not have the strength to hold onto the infant/child during emergency airline situations. There have been several situations in which the infant/child was pulled away from the adult due to the g-force, and therefore severely injured or killed.

OBJECTS AND ADVANTAGES

Accordingly, several objects and advantages are, to provide a body embracing harness which securely restrains the infant/child to the adult. Use of this invention will prevent an infant/child from being pulled away from the adult by the g-force experienced during emergency situations, and therefore injured or killed.

Another object is to provide an improved manner in which to carry an infant/child while allowing the adult to have complete use of his or her arms. This will allow the adult the ability to support both people in the event of an emergency situation.

Another object is to provide a harness/vest apparatus that is adjustable to fit an infant/child as well as an adult of many different sizes.

A further object is to provide a harness/vest apparatus that is comfortable to wear, convenient to manipulate, attractive in appearance and quick to operate.

A still further object is to provide a harness/vest apparatus that is relatively simple in design and construction and inexpensive to manufacture.

Further objects and advantages of my invention will become apparent from a consideration of the drawings and ensuing description.

DRAWING FIGURES

In the drawings, closely related figures have the same number.

List of Reference Numerals

10—Strong fabric or canvas
12—Adjusting strap
14—Adjusting buckle
16—Safety clip
18—Lead strap
20—Waist strap
22—Shoulder strap
24—Crotch strap
26—Back strap
28—Zipper
30—Chest strap
32—Front Edge
34—Side Edge

SUMMARY

This invention is directed to a safety harness/vest, that when properly used will restrain a infant/child to the upper body of an adult. The harness/vest apparatus is for use during flight, so that in the event of an emergency, the infant/child will not be pulled away from the adult and severely injured or killed.

DESCRIPTION OF THE INVENTION

Figure 1:
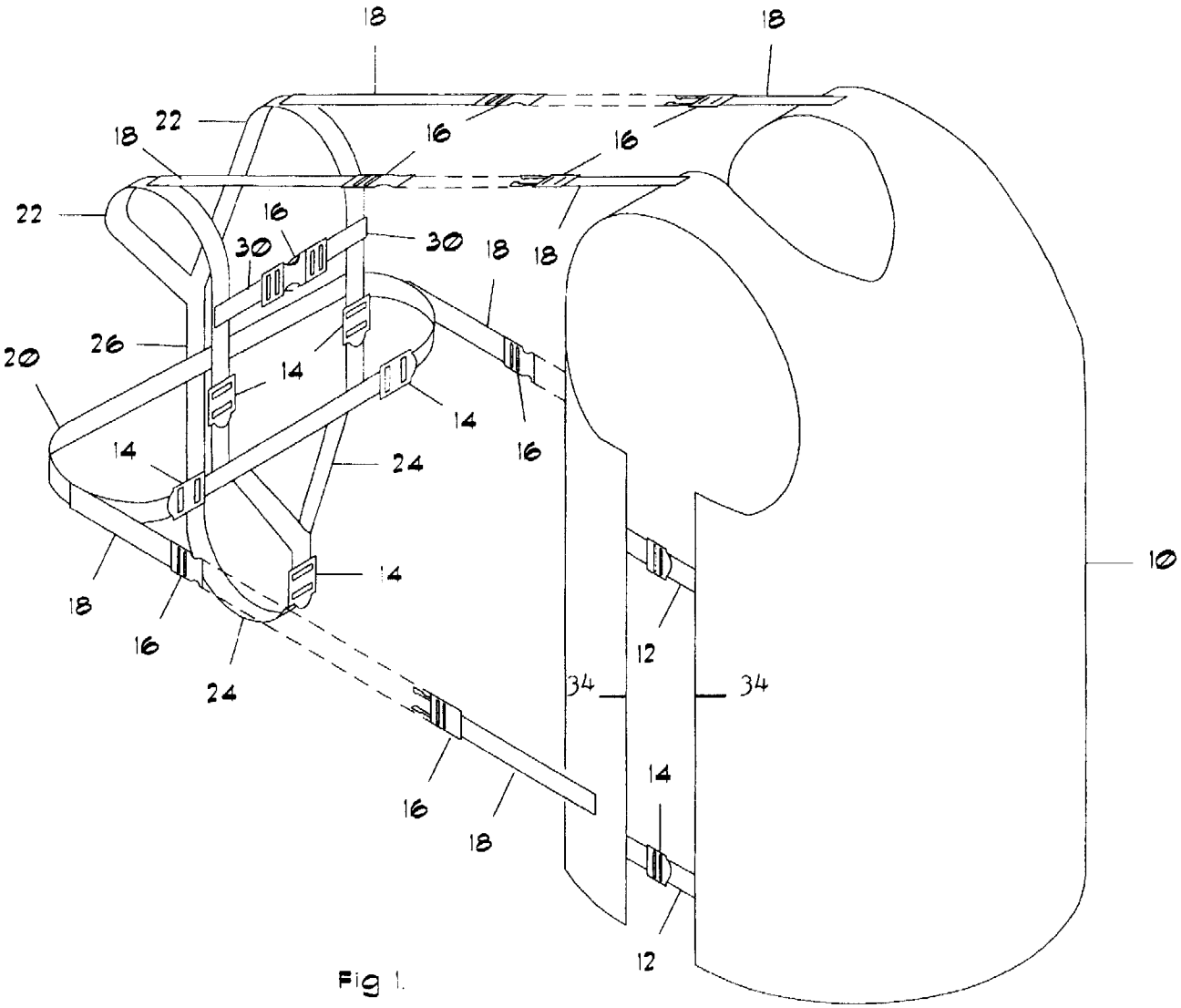
FIG. 1 is a exploded view of how the child's safety harness and the adults vest are attached together.

FIG. 1, shows a exploded view of a basic version of the harness/vest apparatus being attached. Adult vest 10 is made of a relatively strong fabric. It has straps 12 and buckles 14 on each side edge 34 of the waist to allow for adjustability. The vest 10, also has four lead straps 18 with safety clips 16 at the end. This is so that the vest and the harness may be attached to each other. Each strap 22 goes over the child's shoulders, and there are buckles 14 on each strap to allow for length adjustments. Back strap 26 extends down the middle of the infant/child's back, becoming the crotch strap 24. The crotch strap 24 also has a buckle 14 to allow for length adjustments. The chest strap 30 has a safety clip 16, to join each of the ends together. The chest strap 30 is to prevent the shoulder straps 22 from becoming loose and slipping off the infant/child's shoulders. All of the straps numbered 12,18, 20,22,24,26 and 30 have a buckle 14 to allow for length adjustments. Also, each strap numbered 18 and 30, terminate in a safety clip 16.

Figure 2:
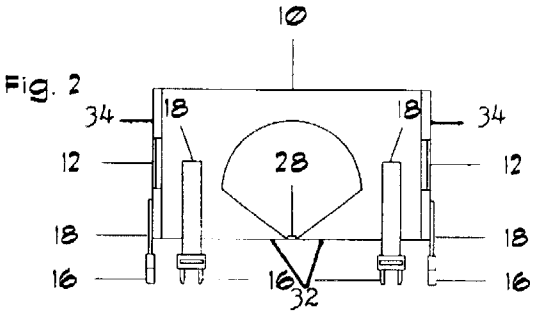
FIG. 2 is a top plan view of the adult's vest.

FIG. 2, shows a top view of the vest 10. Adult vest 10, has straps 12 combined with buckle 14. Each strap 12 and buckle 14 are located on the left and right side edge 34 of the vest 10, and are used to adjust the length of the straps at the adults waistline. Lead straps 18 are located at each of the shoulders and each side of the waistline, they each have a safety clip 16 that is used to attach the harness to the vest. The zipper 28 is used to create closure of front edges 32 of the vest.

Figure 3:
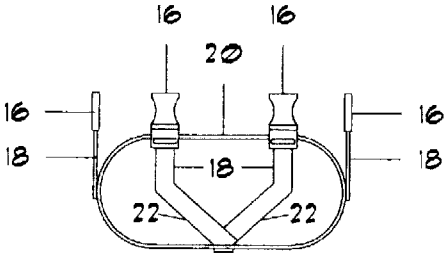
FIG. 3 is a top plan view of the child's harness.

FIG. 3, shows a top view of the child's harness. The shoulder straps 22 are attached to the lead straps 18 that have the safety clips 16 at each end. The lead strap 18 and the safety clips 16 are used to attach the harness to the vest at the shoulder. The waist strap 20 is attached to the lead straps 18 that are attached to the safety clips 16 that attach the harness to the vest at the waistline.

Figures 4, 5, 6, 7, 8:
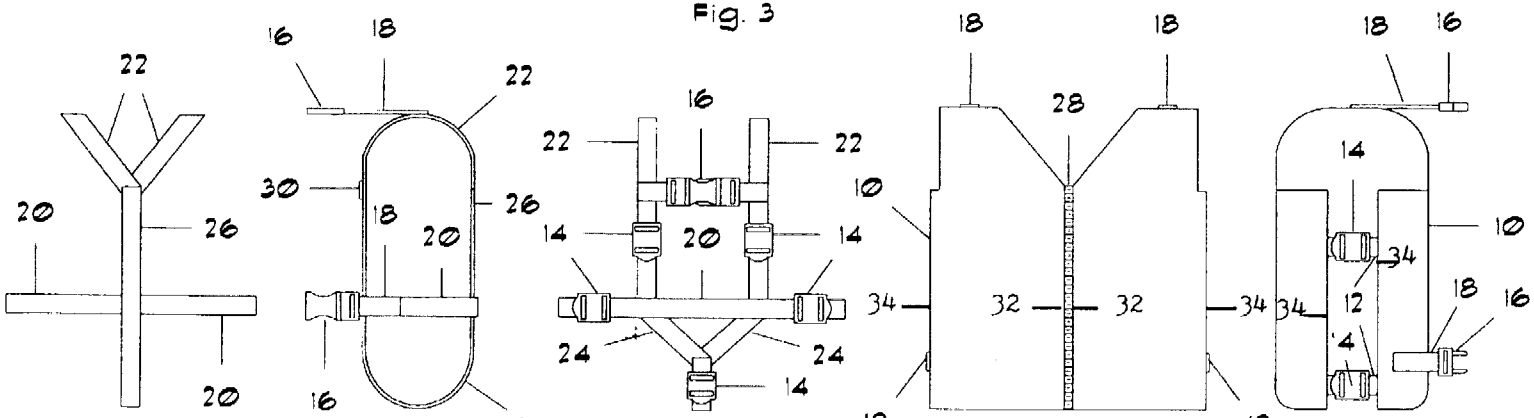
FIG. 4 is a rear view of the child's harness.
FIG. 5 is a side view of the child's harness.
FIG. 6 is a front view of the child's harness.
FIG. 7 is a front view of the adult's vest.
FIG. 8 is a side view of the adult's vest.

FIG. 4, shows a back view of the harness. Shoulder straps 22 attach to the back strap 26 that is also attached to the waist strap 20.

FIG. 5, shows a side view of the harness. The waist strap 20 attaches to the lead straps 18 that are attached to the safety clips 16, which allows the harness to attach to the vest at the waistline. The shoulder straps 22 are attached to the lead straps 18 that are attached to the safety clip 16, which allows the harness to be attached to the vest at the shoulder level. The shoulder straps 22 are also attached to the back strap 26 that becomes the crotch strap 24.

FIG. 6, shows a front view of the harness. The shoulder straps 22 have buckles 14 that allow for length adjustments. Also shown, is the waist strap 20 that has buckles 14 for adjustability. Connected to the waist strap 20 is the crotch strap 24 which also has a buckle 14 to allow for length adjustment.

FIG. 7, shows a front view of the vest. The vest 10 shows the zipper 28 and front edges 32 used for closure. The lead straps 18 are attached to the vest at the shoulder, and they have the safety clips 16 that allow the vest to be attached to the harness. Also side edges 32 are shown.

FIG. 8, shows a side view of the vest. The vest 10, shows the lead straps 18 and the safety clips 16 that allow the vest to be attached to the harness. Also shown, is the strap 12 and the buckle 14, attached to side edge 34, used for adjustability.

Operation of the Invention

The manner of using the harness/vest to secure a infant/child is similar to some of the prior art. However, the main difference is that instead of an infant/child being attached to a crib, bassinet, buggy, tree or etc . . . , the infant/child is securely restrained to the upper body of an adult.

The manner in which to describe the operation of this invention is as follows:

The adult would first put on the vest 10 and zip 28 up the front.

Then the straps 12 on each side of the waistline would need to be fed through the buckles 14 and pulled to a comfortable fit. Then the adult would put the infant/child's legs on each side of the crotch strap 24 and put each of the infant/child's arms under the shoulder straps 22. Once the child is inside the harness, the waist strap 20 would be adjusted by the buckle 14 to an appropriate length. Then the shoulder straps 22 and the crotch straps 24 would be adjusted as well. The next step would be to wrap the chest strap 30 around the shoulder straps 22 to ensure that the shoulder straps 22 will not slip off of the infant/child's shoulders.

After both the harness and vest have been adjusted at all points, then the adult would lift the infant/child to his or her chest, each facing each other. At that point the harness and the vest would be attached to each other by using the lead straps 18 with the safety clips 16 at each side of the shoulder and each side of the waist.

At this point, the infant/child is securely restrained to the upper body of the adult. This allows the adult free use of his or her arms to support the two of them without fear that the infant/child will be pulled away and injured or killed. Also, once the harness and vest are adjusted to size, the two can be detached very easily and re-attached in a matter of seconds.

Summary, Ramifications and Scope

Thus the reader will see that the harness/vest invention can be used to provide a convenient and comfortable manner in which to ensure that for safety reasons, the infant/child that is properly attached to a the adult using the harness/vest apparatus, will not be separated from that adult.

Furthermore, the harness/vest apparatus has the additional advantages in that:

It provides a safe and convenient way in which a infant/child traveling with a adult can be carried and restrained with complete comfort.

It is adjustable to fit many different sizes.

It can be made from a variety of different fabrics and colors.

It can be un-attached and re-attached in a matter of seconds, with minimal effort.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

I claim:

1. A child safety harness for restraining a child to the body of an adult comprising:

a child's harness including a waist strap with buckles for encircling the waist, a vertical back strap, said back straps branching to a first set of two straps which form a first Y at its upper end and a second set of two straps which form a second Y at the other end, the straps of the said first Y extending over the shoulders of a child and connected to said waist strap, the straps of said second Y also being connected to said waist strap, and a chest strap with a safety clip, extending between the straps of said first set of two straps, an adult's vest with two front edges and a zipper to selectively connect the two front edges, said vest having a pair of side edges at each side and adjusting straps with buckles to adjustably secure the side edges of each side, and means for releasably connecting said child's harness in a face-to-face relation with said adult's vest, said means including a strap extending from each of said first set of two straps to said vest and a stop extending from each side of the waist strap to the vest, each of said straps which comprise said means for releasably connecting including safely clips.

* * * * *